United States Patent [19]

Sedlmair

[11] Patent Number: 4,735,434

[45] Date of Patent: Apr. 5, 1988

[54] TOE PIECE FOR A SAFETY SKI-BINDING

[75] Inventor: Gerhard Sedlmair, Farchant, Fed. Rep. of Germany

[73] Assignee: Marker-Deutschland GmbH, Garmisch-Partenkirchen, Fed. Rep. of Germany

[21] Appl. No.: 858,820

[22] Filed: May 2, 1986

[30] Foreign Application Priority Data

May 2, 1985 [DE] Fed. Rep. of Germany ..... 3515847

[51] Int. Cl.[4] ..... A63C 9/085

[52] U.S. Cl. ..... 280/625; 280/629; 280/634

[58] Field of Search ..... 280/625, 629, 634

[56] References Cited

U.S. PATENT DOCUMENTS

| | | | |
|---|---|---|---|
| 3,685,849 | 8/1972 | Marker et al. | 280/629 |
| 4,166,636 | 9/1979 | Svoboda et al. | 280/635 |
| 4,398,747 | 8/1983 | Bernard et al. | 280/634 |
| 4,660,849 | 4/1987 | Sedlmair et al. | 280/625 |

FOREIGN PATENT DOCUMENTS

| | | | |
|---|---|---|---|
| 1809889 | 5/1975 | Fed. Rep. of Germany . | |
| 1910808 | 9/1975 | Fed. Rep. of Germany . | |
| 482452 | 1/1970 | Switzerland | 280/625 |

OTHER PUBLICATIONS

Application Ser. No. 762,915, Sedlmair et al., filed 8/5/85.

*Primary Examiner*—John J. Love
*Assistant Examiner*—Eric Culbreth
*Attorney, Agent, or Firm*—D. Peter Hochberg; Mark M. Kusner; Walter C. Danison, Jr.

[57] ABSTRACT

A toe piece for safety ski-bindings, which toe piece can pivot outwardly in a sideways direction against a biasing force if excessive lateral forces occur. A supporting member (8) is connected to two side holding members (9,10) adapted to support the sole of the boot in lateral and frontal directions. The support member (8) forms the coupling means of a linkage quadrangle which can pivot laterally. The side holding members (9,10) extend beyond the point where they are mounted to the support member. Each side holding member is releasably locked by means of a lever (27,28) mounted on the extensions thereof. A locking member (14) cooperative with the levers is adapted to release the appropriate side holding member when the linkage moves beyond a predetermined distance from center.

11 Claims, 4 Drawing Sheets

TOE PIECE FOR A SAFETY SKI-BINDING

BACKGROUND OF THE INVENTION

The present invention relates to ski-bindings, and more specifically to a toe piece of a safety ski-binding which is pivotable in a lateral direction against a biasing force when excessive side forces occur.

Toe pieces of the aforementioned type are known from different references (e.g. DE-AS Nos. 18 09 889 and 19 10 808) but have not yet been introduced into the market. Such toe pieces have an advantage with respect to other toe pieces known heretofore which are currently available insofar as their side holding members follow the pivotal movement of the ski boot in the yielding area of the toe piece, such that friction between the side holding members and the shoe sole is avoided in this area. As a consequence, only a small sensitivity with respect to the pressure caused by the toe holder exists, and a relatively good reset characteristic is obtained.

Toe pieces of this type (i.e. DE-AS Nos. 18 09 889 and 19 10 808) however, show relative movement between the side holding members and the linkage quadrangle in the yielding area, which movement will cause friction with the known disadvantages attendant thereto.

SUMMARY OF THE INVENTION

It is therefore an object of the present invention to modify and design a toe piece for a safety ski-binding which is pivotable in a lateral direction against a biasing force when excessive side forces occur.

Another object of the present invention is to keep the internal friction of the toe piece as small as possible.

A still further object of the present invention is to provide a toe piece as described above having improved reset characteristics.

In accordance with the preferred embodiments of the present invention, constructions are provided in which, during the pivotal movement of the toe piece, no relative movement occurs between a coupling means and a cooperating side holding member. A simplification as far as the design of the present toe piece is concerned, as compared with the known toe piece, can be achieved in accordance with the invention by providing that the side holding members are positioned adjacent the mounting pins of the supporting member (the coupling means) where the side portions of the linkage quadrangle are attached thereto.

In accordance with one aspect of the present invention, a locking element in the form of a locking pin is provided for each side holding member and the lever is located at the extending portion of the side holding member and has a claw-like configuration. The claw-like lever resiliently grips behind the locking pin to lock the side holding member, and cooperates with an abutment fixedly mounted to the base plate to release same.

In this respect, it is desirable to provide each clawlike lever with a wound bending spring, which bending spring is mounted on the extending portion of the side holding member.

In accordance with another aspect of the present invention, the activating element is centrally located with respect to the coupling means and is arranged in an axially parallel relationship with respect to the side holding members. Further, abutments are provided on both sides of the symmetrical plane of the side holding members to engage the element and activate release.

Preferably, the levers located at the extending portion of the side holding members are supported levers which are associated with the activating element. In this respect, each supported lever includes a guide pin arranged in a parallel relationship with respect to the axis, and in each supporting member for each guide pin a slot is provided which limits the extended position of the supporting lever and the extension of the side holding member when they are pivoted.

It is desirable to hold the levers resiliently (by spring action) in their normal position so that even for heavy skiing a good operation safety exists.

According to an embodiment of this inventive concept, the levers are held in their normal position by means of a cam disk which is movable against a spring force acting in the longitudinal direction of the toe piece. A particularly simple embodiment is achieved due to the fact that the spring force of the detent means acts also upon the cam disk.

BRIEF DESCRIPTION OF THE DRAWINGS

Embodiments of the toe piece of the invention will be described in detail in connection with the attached drawings in which.

DETAILED DESCRIPTION OF THE PREFERRED EMBODIMENT

Figure 1:
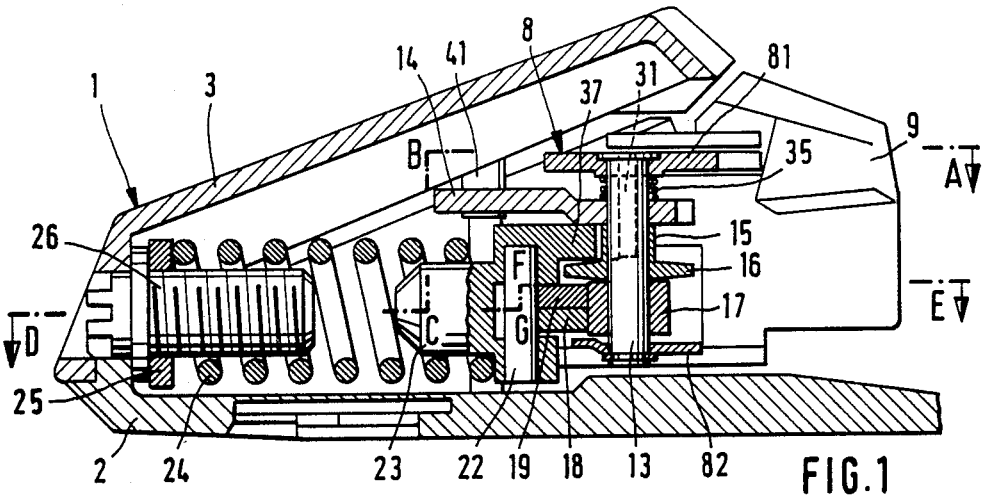
FIG. 1 is a central longitudinal sectional view of a toe piece illustrating a first embodiment of the present invention.

Referring now to the drawings, FIGS. 1–4 disclose a toe piece having a housing 1. Housing 1 includes a base member 2 which is adapted to be fixedly mounted on a ski in a conventional manner. Housing 1 further includes a cover member 3 which is mounted on the base member 2. Side portions 6 and 7 of a linkage quadrangle are rotatably mounted on two vertical axes 4 and 5 within housing 1. The coupling means of the linkage quadrangle is identified by reference numeral 8. Coupling means 8 serves as a supporting member for two side holding members 9, 10 which engage the sole of a boot. Each of the side holding members 9, 10 is rotatably supported on a mounting pin 11 and 12, which pins also connect coupling means 8 with side portions 6, 7.

Figure 3:
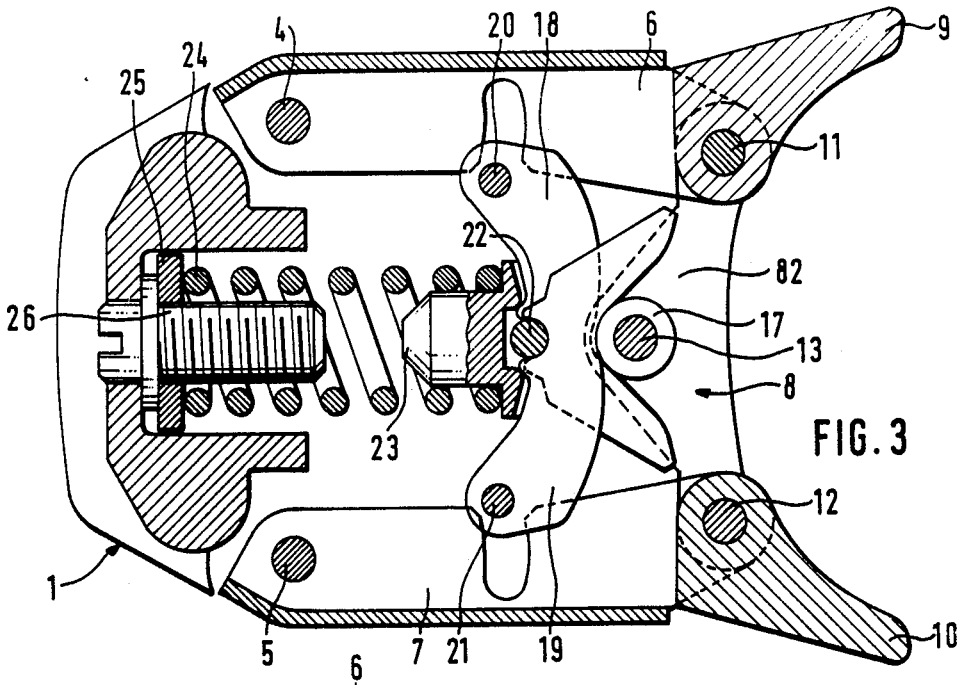
FIG. 3 is a section taken along line E-F-G-D in FIG. 1.

Coupling means 8 is formed by two stamped sheet metal pieces 81, 82 which are shown in a cross-sectional view in FIG. 1. Stamped sheet metal pieces 81, 82 are movably mounted in a parallel, spaced-apart relationship on the mounting pins 11 and 12. FIG. 3 shows a top view of the stamped sheet metal piece 82.

Within coupling means 8, formed by said stamped sheet metal pieces 81, 82, a pin 13 is provided and extends axially parallel to the mounting pins 11, 12. Pin 13 supports a locking element 14, a guide sleeve 15 having a flange 16 and a detent roller 17. When the toe piece is in its normal position detent roller 17 is in engagement with a detent recess best seen in FIG. 3. The detent recess is comprised of two arms 18 and 19 which cross each other and which are of similar mirrored design. Each arm 18, 19 is mounted on an axis 20, 21 respectively, which axes extend parallel to the axes 4 and 5 of housing 1. Both arms 18, 19 are under the influence of a coil pressure spring 24 via a pin 22 which is arranged in a pressure member 23. As best seen in FIG. 3, coil pressure spring 24 abuts housing 1 via a nut 25 and an adjustment screw 26.

Side holding members 9, 10 include a portion which extends beyond the mounting pins 11 and 12. At each of these extending portions, a lever 27 and 28, respectively, is mounted. Side holding members 9, 10 are associated with locking element 14 via levers 27 and 28. In this respect, locking element 14 includes two stepped portions 29, 30. Abutments 41, 42 are symmetrically mounted on the housing of the toe piece for cooperation with the locking element 14. In the embodiment heretofore described, abutments 41, 42 are provided on the axes 20, 21 which axes also support arms 18, 19 which form the detent recess.

Each lever 27, 28 which is associated with locking element 14, includes a guide pin 31, 32 respectively. Guide pins 31, 32 extend parallel to the other axes. For each guide pin, a slot 33, 34 is provided in stamped sheet metal piece 81. The purpose of said slots 33, 34 will be discussed in detail below. Between the locking element 14 and stamped sheet metal piece 81, a wound bending spring 35 is supported on pin 13. Bending spring 35 extends with its free ends 36 behind guide pins 31, 32 so as to biasingly hold guide pins 31, 32 in their normal position shown in FIG. 2. In addition to guide pins 31, 32 and slots 33, 34, a cam disk 37 is provided for securing the position of the supporting levers 27, 28. Cam disk 37 is mounted on pin 22 and is under the load of the coil pressure spring 24. During movement of pin 22 in the longitudinal direction of the toe piece, the cam disk 37 is guided between axes 20, 21. At both lateral ends of the effective surface of cam disk 37, ramps 38, 39 are provided for guide pins 31, 32, respectively.

Guide pins 31, 32 extend beyond levers 27, 28 in the upward as well as the downward direction. As set forth above, the upper ends of guide pins 31, 32 extend into slots 33, 34 of stamped sheet metal piece 81, and the lower ends extend from cam disk 37 into the vicinity of flange 16 of guide sleeve 15.

Figure 2:
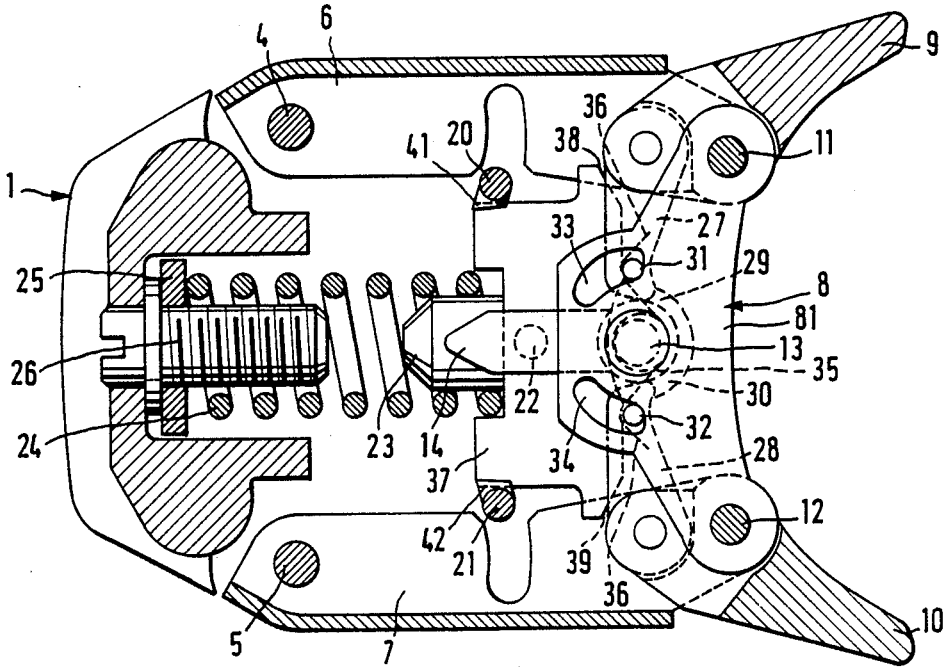
FIG. 2 is a cross-sectional view taken along line A-B-C-D of FIG. 1.
Figure 4:
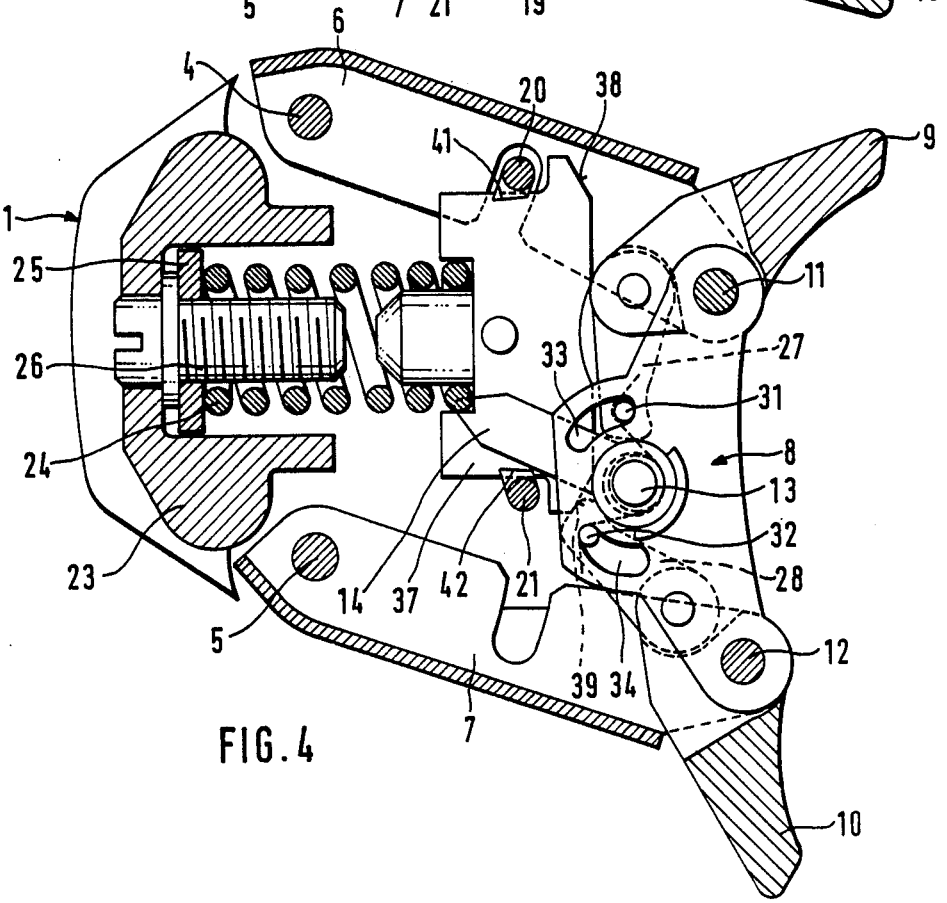
FIG. 4 is a sectional view showing the toe piece in the release position.

Side portions 6, 7 of the linkage quadrangle are formed of substantially U-shaped stamped sheet metal pieces which are shown as webs in the cross-sectional views of FIGS. 2–4. As seen in the drawings, a cut-out portion is provided in side portions 6, 7 into which axes 20, 21 may extend when the linkage pivots. As set forth above, axes 20, 21 are fixedly mounted on base member 2 and pivotally support arms 18, 19 which form the detent recess for detent roller 17.

The normal position of the individual portions of the toe piece are shown in FIGS. 1–3. In the event that a boot (not shown) transmits a force onto one of side holding members 9, 10, which force exceeds the bias of the coil pressure spring 24, pivotal movement of the linkage quadrangle about the axes 4, 5 occurs. Importantly, side holding members 9, 10 do not change their angular orientation with respect to coupling means 8. If the force decreases, the linkage quadrangle moves back towards its normal position due to the influence of coil pressure spring 24. If an excessively high force is applied to a side holding member (for example to side holding member 10) the coupling means 8 is moved sideways to a position wherein the locking element 14 engages corresponding abutment 42. Lever 28 is released if further movement of the coupling means occurs, release of the lever 28 being caused by the stepped portion 30 of locking element 14 which rotates with respect to coupling means 8. As a consequence of such rotation, the side holding member 10 can pivot to its release position shown in FIG. 4 wherein release of the ski boot in a sideway direction is possible. Pivotal movement of side holding members 9, 10 occurs against the relatively small force of spring 35, a spring which effects the return of the side holding member into the initial position after the boot has been released from the toe piece. At the same time, the linkage quadrangle also returns to its normal position due to the influence of spring 24. In addition, cam disk 37 moves toward the righthand side with respect to the representation shown in FIG. 4 such that the operative surface of the cam disk 37 is again located in front of guide pins 31, 32, as shown in FIG. 2.

Slots 33, 34 in the stamped sheet metal piece 81 are dimensioned such that the point or position where levers 27, 28 are mounted to the side holding member cannot reach a critical line between mounting pins 11, 12, and a respective guide pin 31, 32 (see FIG. 4). As a result of this design, a safe reset of the side holding member is provided, be it under the influence of spring 35 or of the cam disk 37. Further, simultaneously with the reset of the supporting lever 27, 28, reset of the locking element 14 occurs. In this respect, no special holding spring or reset spring is necessary for locking element 14.

Figure 5:
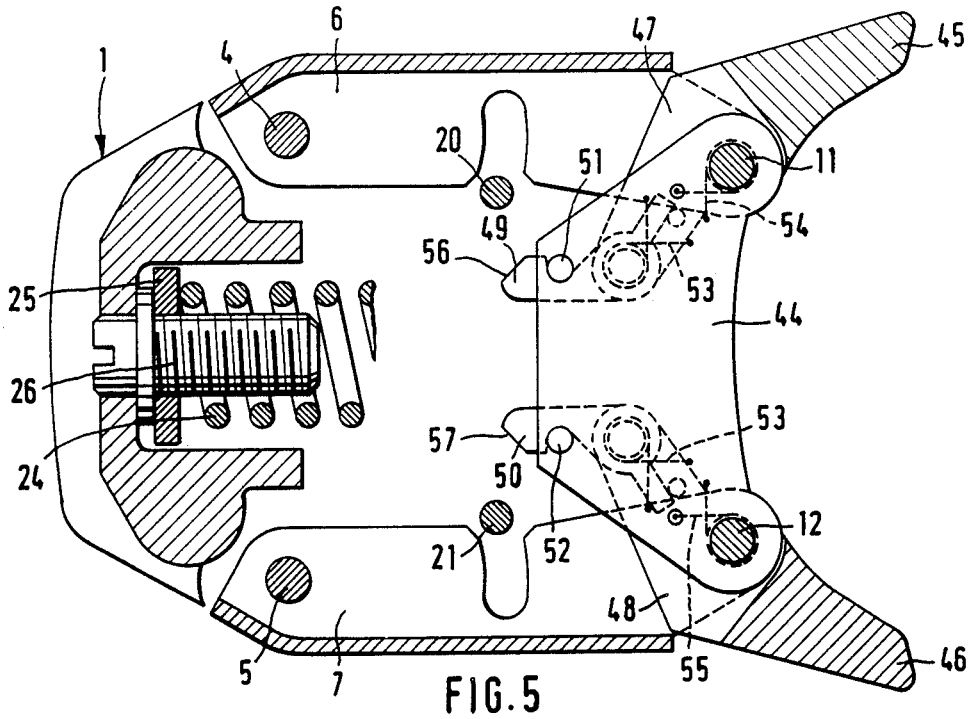
FIG. 5 is a plan view in cross-section illustrating a second embodiment of the present invention.
Figure 6:
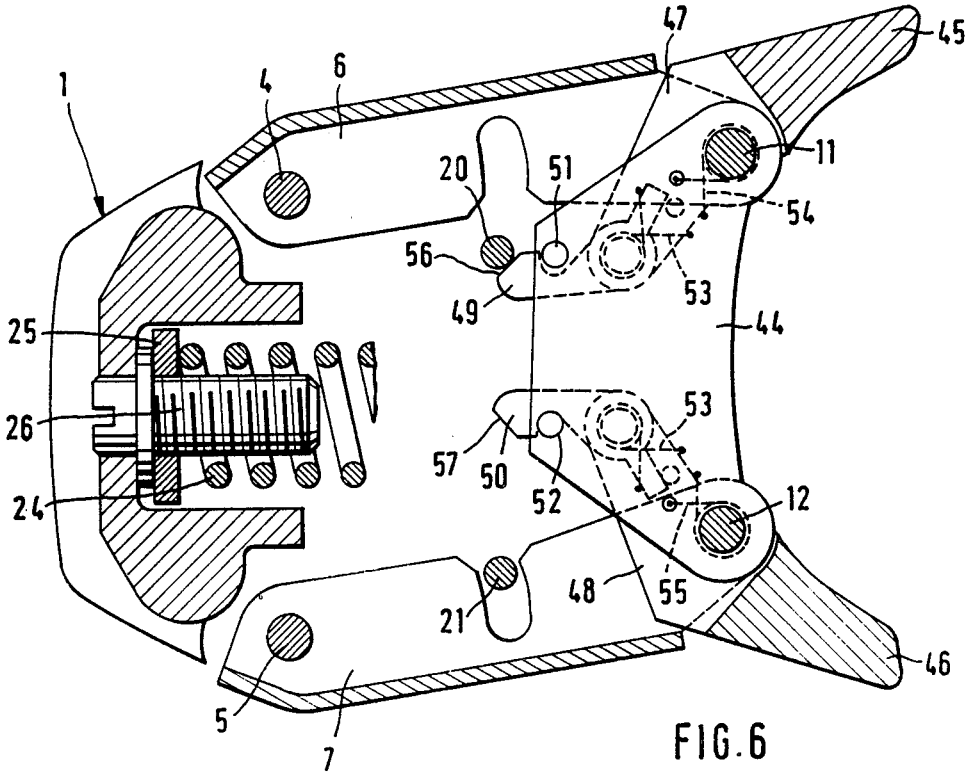
FIG. 6 is a cross-sectional view corresponding to FIG. 5, showing, the momentary position of the toe piece at the end of the yielding path; and, FIG. 7 is a cross-sectional view similar to FIGS. 5 and 6, showing the toe piece in a release position.
Figure 7:
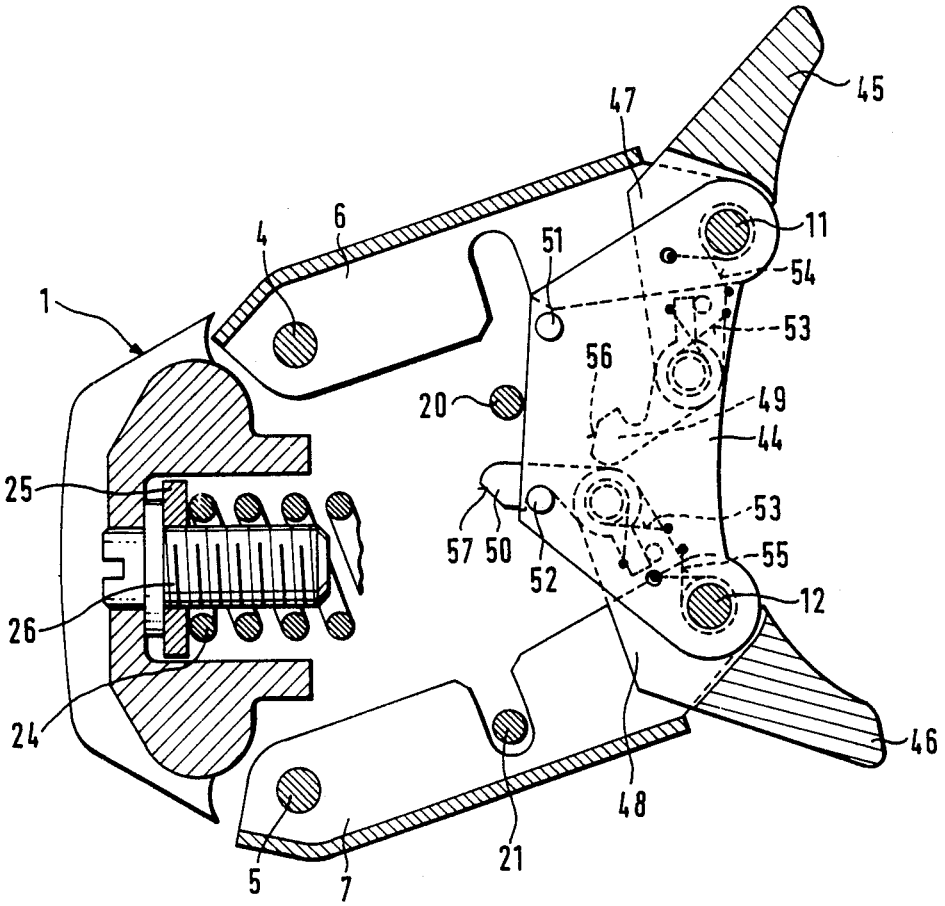

Referring now to FIGS. 5–7, an alternate embodiment of a toe piece which differs only slightly from the toe piece described above is shown. For the purpose of clarity, like reference numerals will be used to describe like components. Also, in this respect, the description of the construction of the toe piece will not be repeated.

The embodiment shown in FIGS. 5–7 includes coupling means 44 which is formed by two stamped sheet metal pieces which are mounted in parallel spaced relationship on mounting pins 11 and 12. As in the previously described embodiment, side holding members 45, 46 are also mounted on mounting pins 11, 12. Side holding member 45, 46 include extensions 47, 48 respectively, which extensions support levers 49, 50. Levers 49, 50 are designed to have a claw-like configuration.

Between the stamped sheet metal pieces which form coupling means 44, two locking pins 51, 52 are provided parallel to the mounting pins 11, 12. In the normal position of the toe piece, each of claw-like levers 49, 50 extends behind a respective locking pin 51, 52. In this position, outward pivotal movement of side holding members 45, 46 is avoided. Each claw-like levers 49, 50 is held in its locking position due to the influence of a wound bending spring 53. Each side holding member 45, 46 is also under the influence of a reset spring 54, 55, respectively. Reset springs 54, 55 are also designed as a wound bending spring, with a supporting leg being hooked to coupling means 44.

The claw of each claw-like lever 49, 50 includes an angled surface 56, 57, respectively, which are provided for cooperation with an abutment fixedly mounted on base member 2. In this respect, according to the present embodiment axes 20, 21 alone are used as abutments.

FIG. 5 discloses the toe pieoe in its normal position. As in the first embodiment pivotal movement of the linkage quadrangle occurs about the axes 4, 5, a force exceeding the bias of the coil pressure spring 24 occurs at one of side holding members 45, 46. If this application of a force is of a corresponding size and time, then, at the end of a path wherein the linkage yields (see FIG. 6), angled surface 56 of the claw-like lever 49 abuts with axis 20, wherein claw-like lever 49 is disengaged from locking pin 51. As a result, side holding member 45 is released and can move into the release position shown in FIG. 7 such that a release of the ski boot in sideways direction is possible. As will be appreciated, pivotal movement of side holding members 45 occurs against the resistance of the reset spring 54, such that upon release of the ski boot, side holding member 45 returns into its normal position. In like manner, the claw-like lever connected with the side holding member returns to its original position, i.e., the claw-like lever under the influence of spring 53, abuts behind locking pin 51 when side holding member 45 reaches its normal position. Thereupon, the toe piece again returns to its normal position shown in FIG. 5 simultaneously with the complete reset of the linkage quadrangle.

The invention has been described in detail with particular reference to its preferred embodiments, but it should be understood that variations and modifications within the spirit and scope of the invention may occur to those skilled in the art to which the invention pertains.

I claim:

1. A toe piece for holding a ski-boot in a safety ski binding, said toe piece being pivotable against a biasing force when excessive side forces occur, said toe piece comprising:

a base plate;

a pair of elongated, generally parallel side members, each pivotally mounted at one end on said base plate;

coupling means pivotally connecting the other ends of said side members to each other to form a linkage, said linkage being laterally movable relative to said base plate about said pivotally mounted ends of said side members;

detent means operative against a biasing force for centering said linkage;

a pair of side holders pivotally connected to said coupling means, said side holders laterally holding the sole of a boot;

a pair of levers having first and second ends, said first end of each lever pivotally connected to a respective one of said side holders, each of said levers being operative to maintain its respective side holder in a boot holding position when said lever is in a first position and to allow movement of said side holder to a boot releasing position when said lever is in a second position;

a lever actuating means centrally located relative to said side holders and pivotally mounted on said linkage being operative to maintain said levers in said first position when said linkage is within a predetermined distance from center; and, means for rotating said actuating element when said linkage moves said predetermined distance from center to cause the second end of the lever on the side to which said linkage moves to shift said lever from said first position to said second position thereby releasing the sideholder on the side to which said linkage moves.

2. A toe piece as defined in claim 1 wherein said actuating element includes an elongated free end.

3. A toepiece as defined in claim 1 wherein:

said coupling means comprises a plate having slots therein; and, said locking levers each include a pin extending from said second end thereof into the respective slots in said coupling member.

4. A toepiece as defined in claim 1 further comprising a cam disc operative to maintain said levers in said first position when said linkage is within said predetermined distance.

5. A toepiece as defined in claim 1 wherein said actuating element includes stepped means engaging said second ends of said lever, said stepped means causing the second end of said one of said levers to shift from said first position to said second position when said linkage moves beyond said predetermined distance from center in the direction of said one of said levers.

6. A toe piece as defined in claim 1 wherein a biasing spring biases said lever pins toward said first position.

7. A toe piece as defined in claim 1 wherein said means for rotating said actuating element is comprised of abutment means fixed relative to said base plate, said abutment means engaging said actuating element and causing rotation thereof when said linkage moves beyond said predetermined distance.

8. A toepiece as defined in claim 7 wherein said abutment means comprises a pair of pins fixed with respect to said base on opposite sides of said actuating member, said actuating element including an elongated free end positioned to engage said pins when said linkage is moved beyond said predetermined distance.

9. A toe piece as defined in claim 1 wherein said detent means comprises a detent roller, a detent recess, and means biasing said recess toward said roller.

10. A toe piece as defined in claim 9 wherein: said detent recess is comprised of two crossed arm members, each pivotally mounted to said base means at one end; and, said detent roller is centrally located relative to said coupling means.

11. A toepiece as defined in claim 10 and further comprising pin means mounted on said base plate, said lever actuating element and said detent roller being mounted on said pin means.

* * * * *